· United States Patent [19]
Cho et al.
[11] Patent Number: 4,867,024
[45] Date of Patent: Sep. 19, 1989

[54] LOCKING ROTARY DIE CUTTING COVER

[75] Inventors: Hyun J. Cho; Seth Pickering, III, both of Tulsa, Okla.

[73] Assignee: TDW Delaware, Inc., Wilmington, Del.

[21] Appl. No.: 308,637

[22] Filed: Feb. 10, 1989

[51] Int. Cl.[4] ..... B26D 7/20
[52] U.S. Cl. ..... 83/659; 83/347; 83/698
[58] Field of Search ..... 83/346, 347, 659, 658, 83/510, 511, 698

[56] References Cited

U.S. PATENT DOCUMENTS 3,633,246 1/1972 Kirkpatrick ..... 83/659
3,739,675 6/1973 Duckett et al. ..... 83/347
3,765,329 10/1973 Kirkpatrick et al. ..... 83/659
3,885,486 5/1975 Kirkpatrick et al. ..... 83/347
4,073,207 2/1978 Kirkpatrick ..... 83/347
4,073,208 2/1978 Kirkpatrick ..... 83/347
4,191,076 3/1980 Bollmer et al. ..... 83/347

*Primary Examiner*—Frank T. Yost
*Assistant Examiner*—Scott A. Smith
*Attorney, Agent, or Firm*—Head & Johnson

[57] ABSTRACT

A rotary die cutting cover for use on a die cutting cylinder, in which the cylinder has a cylindrical external surface and a recess slot extending the length of the cylindrical surface, the cover being formed of a mat of resilient, flexible material having integral increased thickness end portions which are received in the cylinder recess slot and in which one mat end portion has a bottom surface having a narrow slot therein extending the width of the mat, the narrow slot allowing the mat end portion to compress as it is inserted into the cylinder recess slot.

3 Claims, 1 Drawing Sheet

LOCKING ROTARY DIE CUTTING COVER

SUMMARY OF THE INVENTION

The present invention relates to the rotary die cutting art and more particularly to an improved selflocking rotary anvil cover used in cutting of corrugated boxes and the like.

In the rotary die cutting art, rotary anvil construction employs covers of resilient material such as rubber, synthetic rubber, polyurethane, and the like against which the cutting die works. Prior art relating to the use of such covers for die cutters may be found in U.S. Pat. Nos. 3,274,873 and 3,522,754. The use of such flexible mates as covers for rotary die cutting cylinders is well known. A means commonly employed for locking such mats in place include the use of a longitudinal recess slot on the cylindrical surface. The mat is typically provided with increased thickness end portions which fit into the recess slot and which thereby maintain the cover in position on the cylinder.

In order to insure retention of the cover the end portions must fit tightly within the cylinder recess slot. With previous designs, positioning the end portions within the recess slot has been difficult. The present invention provides a means of positioning the mat end portions in the recess slot in a way such that the insertion of the end portions is easier, but nevertheless the end portions are securely retained within the cylindrical recess slot.

The rotary die cover of this invention is in the form of a flat mat of resilient, flexible material and of a width equal to or less than that of the length of the cylinder to which the mat is applied. The mat has a top and a bottom surface and a first end and an opposed second end surface. The length of the mat is substantially equal to the circumference of the die cutting cylinder.

The mat has a first integral increased thickness portion at the first end. When the mat is positioned on the cylinder, this first increased thickness end portion is received within the cylinder reset slot and is equal in thickness to that of the mat plus the depth of the recess slot in the cylinder. The first end surface has a longitudinal recess the length of the end surface and spaced from the mat top surface.

The mat second end has an integral increased thickness portion which, when the mat is positioned on a cylinder, is received in the cylinder recess slot. Like the first increased thickness portion, the second increased thickness portion is equal in thickness to that of the mat plus the depth of the recessed slot in the cylinder. The second end surface has a longitudinal recess the length of the end surface and adjacent the mat top surface.

The end surfaces are mated in interlocking relationship when received in the cylinder recess slot. The mat second end increased thickness portion has a bottom surface having a narrow slot therein extending the full width of the mat. The narrow slot allows the mat second end portion to compress as it is inserted into the cylinder recess slot. This substantially increases the ease within which the second end portion is inserted into the recess slot, but at the same time the mat end portions are securely retained within the recess slot to keep the mat in position on the cylinder as it is rotated during cutting operations.

A better understanding of the invention will be had by reference to the following description and claims, taken in conjunction with the attached drawings.

DESCRIPTION OF THE PREFERRED EMBODIMENT

Figure 1:
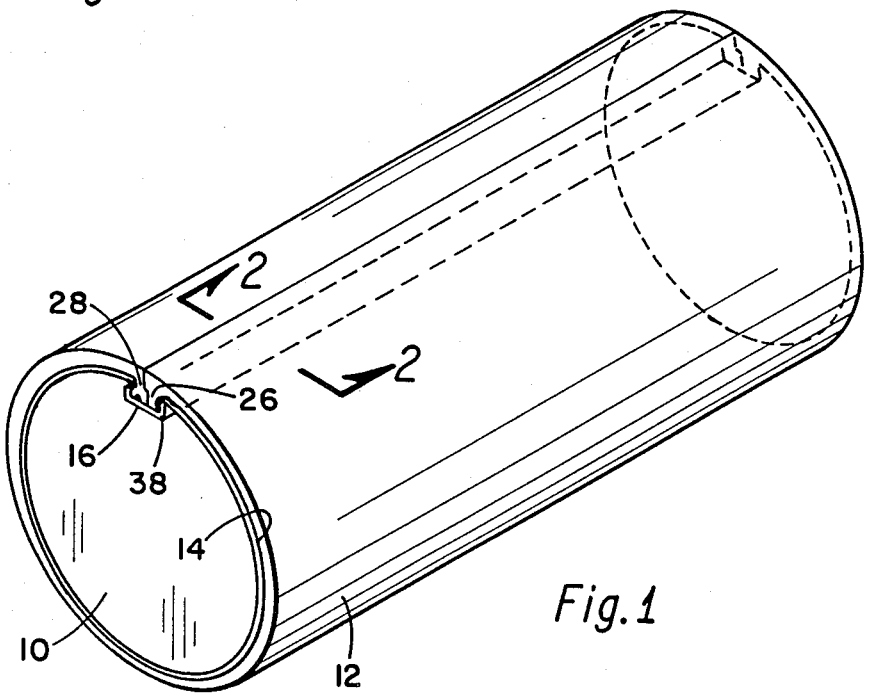
FIG. 1 is an isometric view of a rotary die-cutting cylinder, which is sometimes referred to as a rotary die-cutting anvil, and showing a mat of resilient material formed on the cylindrical surface. The mat is retained on the cylindrical surface employing increased thickness end portions received in a recess slot on the cylindrical surface.

Referring to the drawings and first to FIG. 1, an isometric view of a cylinder for use in a die-cutting machine is shown. The cylinder 10 is shown in diagrammatic arrangement only since the means for rotatably supporting the cylinder is not shown and the cylinder is shown as being of solid cross-sectional configuration which is not necessarily always the case. The cylinder 10 is sometimes referred to as a rotary diecutting anvil in that corrugated paper, a cardboard or other heavy paper is cut by passing the cardboard between the surface of the cylinder 10 and a rotary die (not shown). In order to improve the cutting action, the cylinder 10 is equipped with a cover 12 made of a tough resilient material such as rubber, synthetic rubber, polyurethane, etc. The cylinder 10 has a cylindrical surface 14 onto which the cover 12 fits. Further, the cylinder 10 has an elongated recess slot 16 therein. The cover 12 is held in position on the cylindrical surface 14 of cylinder 10 by increased thickness portions retained within recess slot 16 in a manner which will be described by reference to FIGS. 2 and 3.

Figure 2:
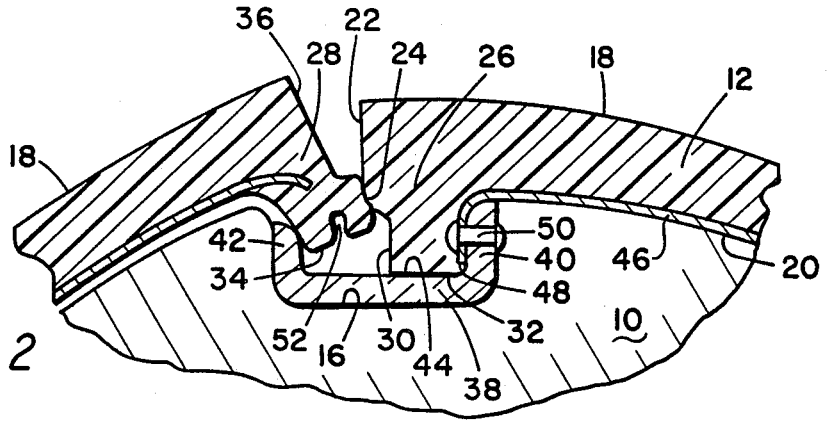
FIG. 2 is an enlarged fragmentary cross-sectional view taken along the line 2—2 of FIG. 1 and showing the rotary die-cutting cover as being positioned in a recess slot in the surface of the die-cutting cylinder.

As shown in FIG. 2, cover 12 is formed as a flat mat of resilient, flexible material and is of a selected width which is not greater than the length of the cylinder. The cover 12 has a top surface 18 and a bottom surface 20. Further, cover 12 has a first end surface 22 and a second end surface 24. In addition, mat or cover 12 has a first increased thickness portion 26 at the first end surface 22 and a second increased thickness portion 28 at the second end surface 24. The function of the increased thickness portions 26 and 28 is to fit into the recess slot 16 in cylinder 10 and retain the cover 12 in position on the cylinder cylindrical surface 14.

The cover first end surface 22 is further characterized by a longitudinal recess 30 which extends the full width of the mat. The longitudinal recess 30 is contiguous with the first increased thickness portion bottom surface 32. The second increased thickness portion 28 also has a bottom surface 34. In addition, the cover second end surface 24 is further characterized by a longitudinal recess 36 which is the length of the end surface and adjacent the mat top surface 18.

In the preferred method of practicing the invention an elongated channel member 38 is employed. The channel member 38 has first and second opposed integral leg portions 40 and 42. The external configuration of the channel 38 is such as to snugly fit within the recess slot 16 formed in cylinder 10. The channel member 38 has an internal U-shaped surface 44 which receives the cover first and second increased thickness portions 26 and 28.

As a further alternate and preferred embodiment, the cover 12 has, secured to the bottom surface 20 thereof, a thin, metal sheet 46 which serves to reinforce and strengthen the cover 12. Metal sheet 46 has a first end 48 which is secured to the channel first leg portion 40, such as by a series of spaced apart rivets 50, only one of which is seen. In this manner, the channel 38 forms a part of the mat 12. The elastomeric mat portion of the cover 12, and particularly the bottom surface 20 thereof, is secured to the metal sheet 46 by adhesive so that with use of the rivets 50 the channel 38 becomes an integral part of the cover.

Figure 3:
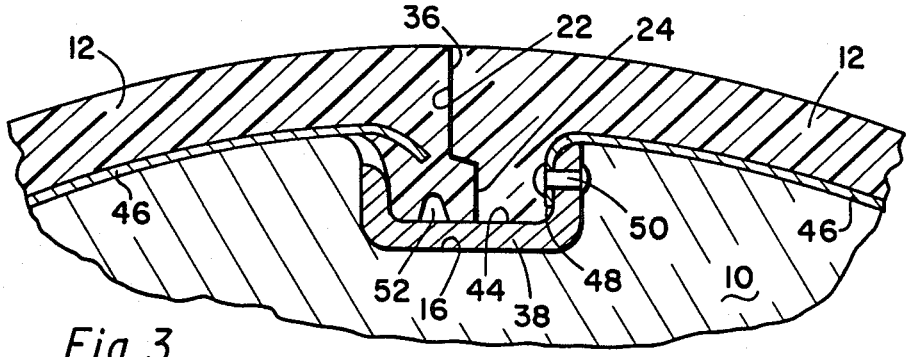
FIG. 3 is an enlarged cross-sectional view as in FIG. 2 but showing the cover as completely installed on the surface of the die-cutting cylinder and ready for use.

The cover is locked in position by inserting the increased thickness portion 12 into position within the channel 38. FIG. 2 shows the end portion 28 in the process of being inserted into position whereas FIG. 3 shows the mat in secure position on the surface of the cylinder 10 and ready for use. In the secure position, the longitudinal recess 30 in the first end surface 32 is contiguous with the mat second end surface 24, and the longitudinal recess 36 in the second end surface 24 is contiguous with the mat first end surface 22. In this manner the mat increased end portion 28 is securely locked within the channel.

The cylindrical cover 12 and its means of retention on the circumferential surface of a cylinder 10 described up to this point is not unlike other retention methods previously known. The present invention is specifically directed towards an improved means of permitting the second increased thickness portion 28 to be more readily inserted into position within channel 38. For this purpose, a narrow slot 52 is formed in the bottom surface 34 of the second increased thickness portion 28. This narrow slot allows the second increased thickness portion 28 below the longitudinal recess 36 to compress as it is forced into position as illustrated in FIG. 2. After the second increased thickness portion 28 is inserted into position within the interior 44 of channel 38, the increased thickness portion expands; that is, the slot 52 widens to securely retain the cover in position on the surface of the cylinder. By providing the narrow slot 52, the dimensions of the cover 12 can be more critically established so that a close mating fit is secured between the cover end surfaces 22 and 24 when the cover is in secured position as shown in FIG. 3. In this manner, the provision of the slot 52 makes it possible to design the cover to be more securely retained in position while at the same time the cover is easier to install on the surface of the cylinder.

In practicing the invention, the channel 38 may be provided with holes therethrough (not shown) and screws employed to secure the channel 38 within the recess slot 16 formed in cylinder 10. That is, screws may be used to retain channel 38 within the recess slot 16.

It can be seen that the principles of the invention remain the same whether or not a channel member 38 is employed and whether or not a metal reinforcing sheet 26 is employed. If a channel member 38 is not employed, the slot 16 within the cylinder 10 will be of the same configuration as the channel U-shaped surface 44.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An improved rotary die cutting cover for use on a die cutting cylinder having a cylindrical external cover receiving surface and having on the cylindrical surface in a plane of the cylindrical axis a recess slot extending the length of the cylindrical surface, the recess slot having a bottom and opposed generally paralleled side walls, the cutting cover comprising:

a flat mat of resilient, flexible material and of a selected width, the mat having a top and a bottom surface and first and second opposed end surfaces, the length of the mat being substantially the circumference of said die cutting cylinder;

the mat having a first integral increased thickness portion at said first end surface which, when the mat is positioned on a cylinder, is received in the cylinder recess slot and is substantially equal in thickness to that of said mat plus the depth of the recess slot in the cylinder, the first end surface having a longitudinal recess the length of the end surface and spaced from the mat top surface;

the mat second end having an integral increased thickness portion at said second end surface which, when the mat is positioned on a cylinder, is received in the cylinder recess slot and is substantially equal in thickness to that of said mat plus the depth of the recess slot in the cylinder, the second end surface having a longitudinal recess the length of the end surface and adjacent said mat top surface, said end surfaces mating in interlocking relationship when received in the cylinder recess slot, and wherein said mat second end increased thickness portion has a bottom surface having a narrow slot therein extending the width of said mat, the narrow slot allowing mat second end portion to compress as said second end portion is inserted into the cylinder slot.

2. An improved rotary die cover according to claim 1 including:

an elongated channel member of stiff material externally cross-sectionally dimensioned to be snugly received within said recess slot of said cylinder, the channel having first and second opposed integral leg portions, said channel member receiving and being secured to said first increased thickness portion and said second increased thickness portion being receivable within said channel member.

3. An improved rotary die cover according to claim 2 including:

a thin sheet of strong material, such as metal, secured to said mat bottom surface and having first and second ends, the first end being included as a part of said mat first increased thickness portion and the second end forming a portion of said mat second end increased thickness portion.

* * * * *